US010995566B2

(12) United States Patent
Shahid et al.

(10) Patent No.: US 10,995,566 B2
(45) Date of Patent: May 4, 2021

(54) AUTOMATIC DRILL PIPE COUPLING DETECTION CONTROL SYSTEM

(71) Applicant: Caterpillar Global Mining Equipment LLC, Denison, TX (US)

(72) Inventors: Ahsan Shahid, Peoria, IL (US); Hyppolite Kuissi, Peoria, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 34 days.

(21) Appl. No.: 16/366,468

(22) Filed: Mar. 27, 2019

(65) Prior Publication Data

US 2020/0308951 A1 Oct. 1, 2020

(51) Int. Cl.

| | |
|---|---|
| ***E21B 19/16*** | (2006.01) |
| ***E21B 44/00*** | (2006.01) |
| ***E21B 17/00*** | (2006.01) |
| ***E21B 17/02*** | (2006.01) |
| ***E21B 19/20*** | (2006.01) |
| ***E21B 19/14*** | (2006.01) |
| ***E21B 47/26*** | (2012.01) |

(52) U.S. Cl.

CPC ..... *E21B 19/16* (2013.01); *E21B 17/006* (2013.01); *E21B 17/021* (2013.01); *E21B 19/146* (2013.01); *E21B 19/20* (2013.01); *E21B 44/005* (2013.01); *E21B 47/26* (2020.05)

(58) Field of Classification Search

CPC ..... E21B 44/005; E21B 47/26; E21B 19/16; E21B 19/20; E21B 17/006; E21B 17/021; E21B 19/146; E21B 19/00; E21B 19/165; E21B 19/18

See application file for complete search history.

(56) References Cited

U.S. PATENT DOCUMENTS

| | | | | |
|---|---|---|---|---|
| 4,110,688 | A * | 8/1978 | Bailey | E21B 19/20 324/207.24 |
| 4,449,592 | A | 5/1984 | Mayer | |
| 4,604,724 | A | 8/1986 | Shaginian et al. | |
| 2013/0255446 | A1 * | 10/2013 | Taggart | E21B 19/16 81/57.11 |
| 2014/0338973 | A1 | 11/2014 | Taylor et al. | |

FOREIGN PATENT DOCUMENTS

| | | | |
|---|---|---|---|
| CN | 203603801 | U | 5/2014 |
| CN | 104695936 | A | 6/2015 |
| CN | 205826284 | U | 12/2016 |
| SU | 1452925 | A1 | 1/1989 |

* cited by examiner

*Primary Examiner* — Brad Harcourt

(74) *Attorney, Agent, or Firm* — Bookoff McAndrews

(57) ABSTRACT

A system for automatic detection of drill pipe coupling on a drilling machine is disclosed. The system may include a rotary head, a drill pipe, a display, and a controller. The controller may be configured to: automatically identify a coupling or decoupling condition of the drill pipe; monitor motion and forces associated with the rotary head during a coupling or decoupling action of the drill pipe; automatically identify a fully coupled or fully decoupled condition of the coupling or decoupling action based on the monitored motion and forces of the rotary head; terminate the coupling action based on the identification of the fully coupled or fully decoupled condition; and update the display to indicate the fully coupled or fully decoupled condition of the drill pipe.

19 Claims, 6 Drawing Sheets

AUTOMATIC DRILL PIPE COUPLING DETECTION CONTROL SYSTEM

TECHNICAL FIELD

The present disclosure relates generally to drilling machines, and more particularly, to an automatic drill pipe coupling detection control system for such machines.

BACKGROUND

Drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more. In order to drill holes to a sufficient depth, the blasthole drilling machine may include one or more drill pipes and/or other drill components that are removably coupled to a rotary head to form a drill string.

The drill pipes may include threaded connections at a top end and a bottom end to facilitate coupling (and decoupling) of the drill pipe to the rotary head, a drill bit, and/or to other drill pipes in the drill string. Coupling or decoupling (e.g., screwing or unscrewing) the threaded connections of the drill pipe while the drill pipe is being added to or removed from the drill string can require intensive labor input, time, and complexity of control to ensure the drill pipe is fully coupled or decoupled. For example, a lack of accuracy in detecting an initial loosening of thread necessitates stopping the operation and repeating the operation manually, thus reducing efficiency. Further, a lack of accuracy in detecting the thread tightening impairs the dependability of the threaded joint, thereby creating a hazard for attending personnel and may result in failure.

An exemplary automatic drill pipe add and remove system is disclosed in U.S. Patent Publication No. 2014/0338973, published on Nov. 20, 2014 ("the '973 publication"). The system of the '973 publication automatically adds a drill pipe to or removes a drill pipe from the drill string by using a control module to interpret signals from a sensor assembly and to control one or more components of the drilling rig. For example, the control module may control a rotary head to couple a drill pipe to or decouple a drill pipe from the drill string based on the signals received from the sensor assembly. However, the '973 publication does not disclose the control module accurately detects and indicates when the drill pipe is fully coupled to or decoupled from the drill string.

The systems and methods of the present disclosure may address or solve one or more of the problems set forth above and/or other problems in the art. The scope of the current disclosure, however, is defined by the attached claims, and not by the ability to solve any specific problem.

SUMMARY

In one aspect, a system for automatic detection of drill pipe coupling on a drilling machine is disclosed. The system may include: a rotary head; a drill pipe; a display; and a controller configured to: automatically identify a coupling or decoupling condition of the drill pipe; monitor motion and forces associated with the rotary head during a coupling or decoupling action of the drill pipe; automatically identify a fully coupled or fully decoupled condition of the coupling or decoupling action based on the monitored motion and forces of the rotary head; terminate the coupling action based on the identification of the fully coupled or fully decoupled condition; and update the display to indicate the fully coupled or fully decoupled condition of the drill pipe.

In another aspect, system for automatic detection of drill pipe count on a drilling machine is disclosed. The system may include: a rotary head; a drill pipe; a display; and a controller configured to: automatically identify a coupling or decoupling condition of the drill pipe; monitor motion and forces associated with the rotary head during a coupling or decoupling action of the drill pipe; automatically identify a fully coupled or fully decoupled condition of the coupling or decoupling action based on the monitored motion and forces of the rotary head; terminate the coupling action based on the identification of the fully coupled or fully decoupled condition; display a count of drill pipes of a drill string connected to the rotary head; and update the count of drill pipes displayed based on the identification of the fully coupled or decoupled condition of the drill pipe to the rotary head.

In yet another aspect, a method for automatic detection of drill pipe coupling on a drilling machine is disclosed. The method may include: automatically identifying a coupling or decoupling condition of a drill pipe; monitoring motion and forces associated with a rotary head of the drilling machine during a coupling or decoupling action of the drill pipe; automatically identifying a fully coupled or fully decoupled condition of the coupling or decoupling action based on the monitored motion and forces of the rotary head; terminating the coupling action based on the identification of the fully coupled or fully decoupled condition; and updating a display of the drilling machine to indicate the fully coupled or fully decoupled condition of the drill pipe.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
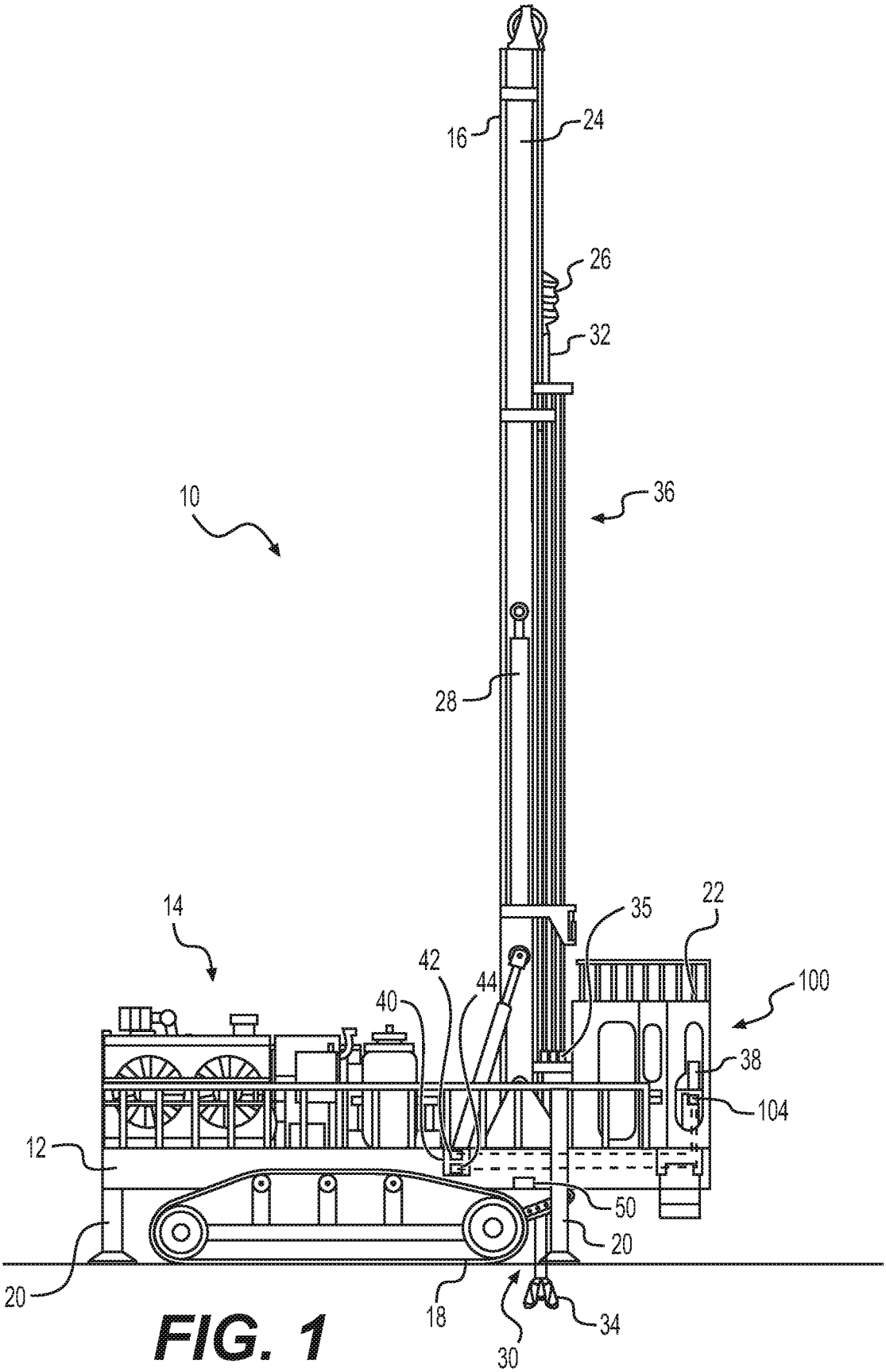
FIG. 1 illustrates a schematic side view of a drilling machine with an exemplary automatic drill pipe coupling detection control system, according to aspects of the disclosure.

FIG. 1 illustrates a schematic side view of an exemplary drilling machine 10, such as a blasthole drilling machine, having an automatic drill pipe coupling detection control system 100 according to aspects of the disclosure. As shown in FIG. 1, drilling machine 10 may include a frame 12, machinery 14, and a drilling mast 16. Frame 12 may be supported on a ground surface by a transport mechanism, such as crawler tracks 18. Crawler tracks 18 may allow drilling machine 10 to maneuver about the ground surface to a desired location for a drilling operation. Frame 12 may further include one or more jacks 20 for supporting and leveling drilling machine 10 on the ground surface during the drilling operation. Frame 12 may support the machinery 14, which may include engines, motors, batteries, pumps, air compressors, a hydraulic fluid source 40 (shown schematically in FIG. 1), and/or any other equipment necessary to power and operate drilling machine 10. Frame 12 may further support an operator cab 22, from which a user, or operator, may maneuver and control drilling machine 10.

As further shown in FIG. 1, drilling mast 16 may include a mast frame 24 which may support a drill motor assembly, or rotary head 26, movably mounted on the mast frame 24. For example, rotary head 26 may be coupled to a cable and pulley system (not shown) and controlled by a hydraulic cylinder 28 (located within mast frame 24) for moving rotary head 26 up and down along the mast frame 24. As such, when hydraulic cylinder 28 is extended, hydraulic cylinder 28 may exert a force (e.g., a pull-down force) on rotary head 26 for pulling-down rotary head 26 along mast frame 24. Likewise, when hydraulic cylinder 28 is retracted, hydraulic cylinder 28 may exert a force on rotary head 26 for hoisting up rotary head 26 along mast frame 24. Hydraulic cylinder 28 may include hydraulic fluid lines (not shown) for receiving and conveying hydraulic fluid to and from the hydraulic cylinder 28. The hydraulic fluid line of hydraulic cylinder 28 may be coupled to one or more hydraulic valves 42 (shown schematically in FIG. 1) of hydraulic fluid source 40 for controlling (via a controller 104) the amount, and flow rate and pressure, of the hydraulic fluid into hydraulic cylinder 28.

Figure 2:
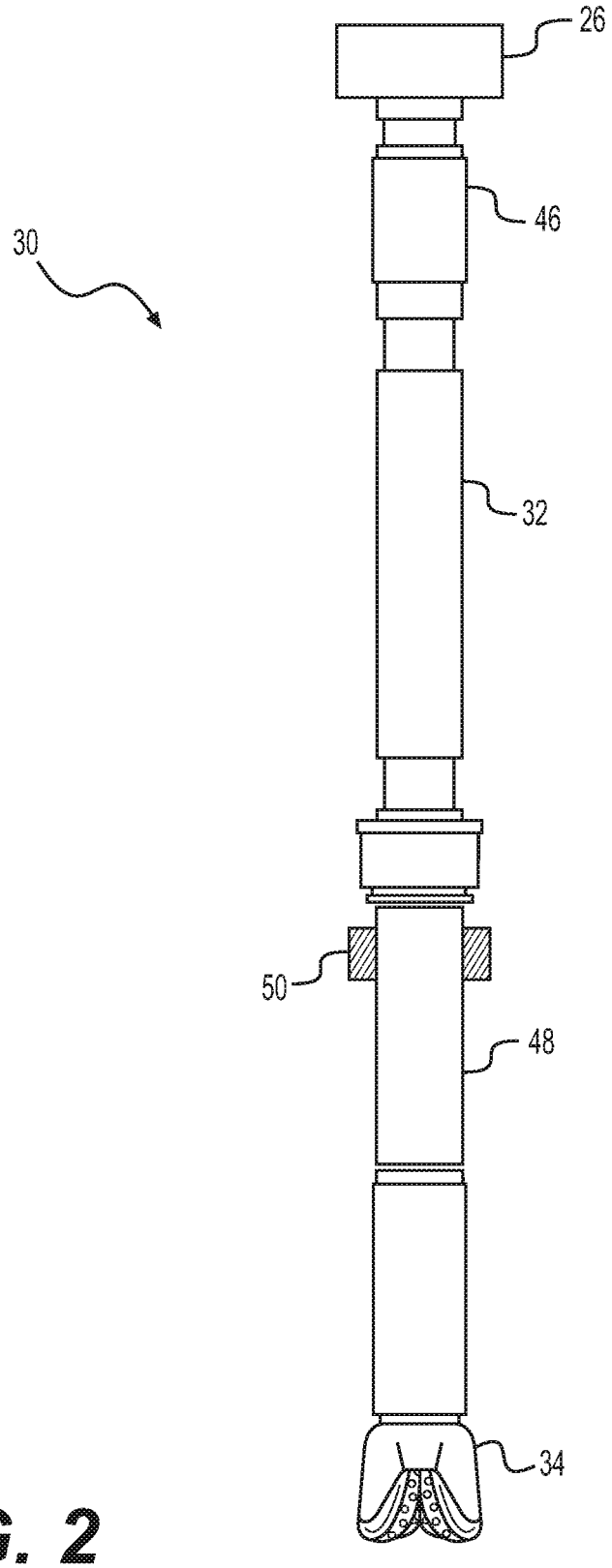
FIG. 2 illustrates a schematic front view of a drill string isolated from the drilling machine of FIG. 1.

Rotary head 26 may couple to, and may be controllable to rotate, a drill string 30 of one or more drill pipes 32 (shown schematically in FIG. 2). A drill tool, such as a drill bit 34, may be mounted at a bottom end of drill string 30 for drilling into the ground surface. It is understood that rotary head 26 may be any type of rotary head, such as a fluid motor-type hydraulic rotary head or the like and drill bit 34 may be any type of drill tool, such as a hammer or the like. Rotary head 26 may further include a hydraulic fluid lines (not shown) for receiving and draining hydraulic fluid. The hydraulic fluid may be used to rotate a shaft of rotary head 26 on which the drill string 30 is connected for rotating the drill string 30 (and thus rotating drill bit 34) at a desired rotation direction and rotation velocity. The hydraulic fluid lines of rotary head 26 may be coupled to one or more hydraulic valves 44 (shown schematically in FIG. 1) of hydraulic fluid source 40 for controlling (via controller 104) the amount, and flow rate and pressure, of the hydraulic fluid into rotary head 26.

Mast frame 24 may also support a drill pipe carousel 36 and a deck wrench 50 (shown schematically in FIG. 1). Carousel 36 may store one or more drill components, such as drill pipes 32. For example, carousel 36 may include one or more slots or cups 35 for receiving the one or more drill components such that carousel 36 may hold and provide drill pipes 32 during the drilling operation. Drill pipe carousel 36 may be pivotably connected to mast frame 24 such that drill pipe carousel 36 may pivot between a pipe storing position and an add or remove position for adding or removing drill pipes 32 to drill string 30 during a drill pipe add or remove operation of drilling machine 10, as detailed further below. Deck wrench 50 may be located on a bottom deck (not shown) of mast frame 24 and may include a claw-like shape corresponding to a shape of drill pipes 32 for holding drill pipes 32 and/or drill bit 34. Deck wrench 50 may further include a hydraulic cylinder (not shown) for extending deck wrench 50 to engage (e.g., hold) drill pipes 32 and/or drill bit 34, as detailed further below.

Figure 6:
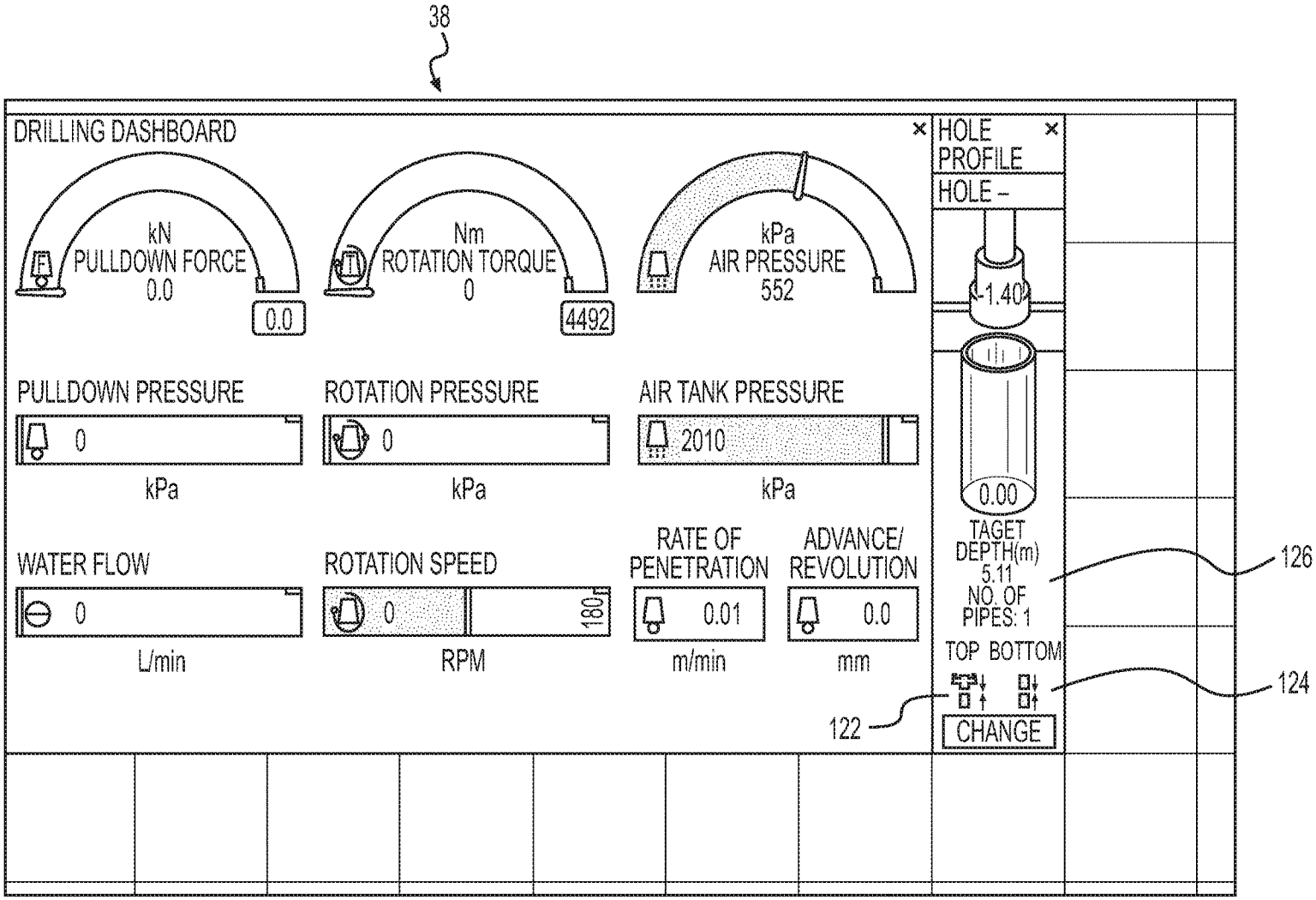
FIG. 6 illustrates an exemplary display of the drilling machine of FIG. 1.

Operator cab 22 may include operator controls (e.g., an input device) that allow one or more operators to monitor and control the operation of the various components of drilling machine 10. For example, a controller 104 provided within operator cab 22 (or in another location) may receive and issue control signals to control operation of the controlling elements of rotary head 26, such as hydraulic valves 42, 44, for controlling a rotation direction, a rotation velocity, and a pull-down force of rotary head 26. Operator cab 22 may further include one or more displays 38 located inside the operator cab 22 for displaying information of the drilling machine 10. The one or more displays 38 may include one such display 38 to indicate coupling and/or count of drill pipes 32 on the drill string 30 (as shown in FIG. 6). As such, display 38 may be in communication with controller 104 for indicating the coupling and/or count of the drill pipes 32.

FIG. 2 illustrates a schematic front view of drill string 30 isolated from drilling machine 10, according to an exemplary embodiment. Drill string 30 may include one or more drill pipes 32 for extending the length of drill string 30 in order to drill to a desired drilling hole depth. While the illustrated embodiment of FIG. 2 depicts a single drill pipe 32 on the drill string 30, it is understood that any number of drill pipes 32 may be added to the drill string 30, as necessary, to drill to a desired hole depth. Drill pipe 32 may be coupled on a first end to rotary head 26 and on a second end to drill bit 34. For example, the first end of drill pipe 32 may include threads (not shown) configured to mate with corresponding threads of an adapter 46 of rotary head 26. Likewise, a second end of drill pipe 32 may include threads configured to mate with corresponding threads of an adapter 48 of drill bit 34. Thus, the drill pipe 32 may be removably coupled to rotary head 26, drill bit 34, and/or to other drill pipes 32 or drill components, accordingly.

Rotary head 26 may be configured to rotate in order to facilitate a coupling or decoupling action of the drill pipe 32 with the rotary head 26 or drill bit 34. For example, rotary head 26 may be controlled to rotate in a coupling direction (e.g., clockwise) to couple (e.g., screw on) a drill pipe 32 to the rotary head 26 or drill bit 34. Similarly, rotary head 26 may be controlled to rotate in a decoupling direction (e.g., counterclockwise) to decouple (e.g., unscrew) a drill pipe 32 from the rotary head 26 or drill bit 34. When a drill pipe 32 is being coupled (e.g., screwed) to rotary head 26, carousel 36 may be controlled to pivot such that drill pipe 32 is aligned with rotary head 26. Carousel 36 may include a breaker plate (not shown) for preventing the drill pipe 32 from rotating during the coupling action. Likewise, when a drill pipe 32 is being decoupled (e.g., unscrewed) from rotary head 26, carousel 36 may be controlled to pivot such that a slot or cup 35 (as shown in FIG. 1) of carousel 36 is aligned with drill pipe 32. As such, drill pipe 32 may be inserted into the slot 35 and may be prevented from rotating by the breaker plate during the uncoupling action.

When a drill pipe 32 is being coupled (e.g., screwed) to or decoupled (e.g., unscrewed) from drill bit 34 (or another drill pipe 32), deck wrench 50 may be controlled to extend and engage adapter 48 of drill bit 34 to prevent drill bit 34 from rotating during the coupling or decoupling action. For example, deck wrench 50 may include a size and shape for holding drill pipes 32 or drill bit 34 to prevent dislocation (e.g., rotation) of the drill pipes 32 or drill bit 34 during the coupling or decoupling action. Further, deck wrench 50 may include a rotation device (not shown), such as a hydraulic breakout wrench, to assist in the initial loosening of the coupling. For example, a fully coupled drill pipe 32 may require a greater torque (e.g., greater than 1,000 Nm) to initially loosen the coupling prior to proceeding with the decoupling action. Accordingly, drill pipes 32 may be coupled or uncoupled at either the rotary head 26 (via carousel 36) or at the drill bit 34 (via deck wrench 50).

Figure 3:
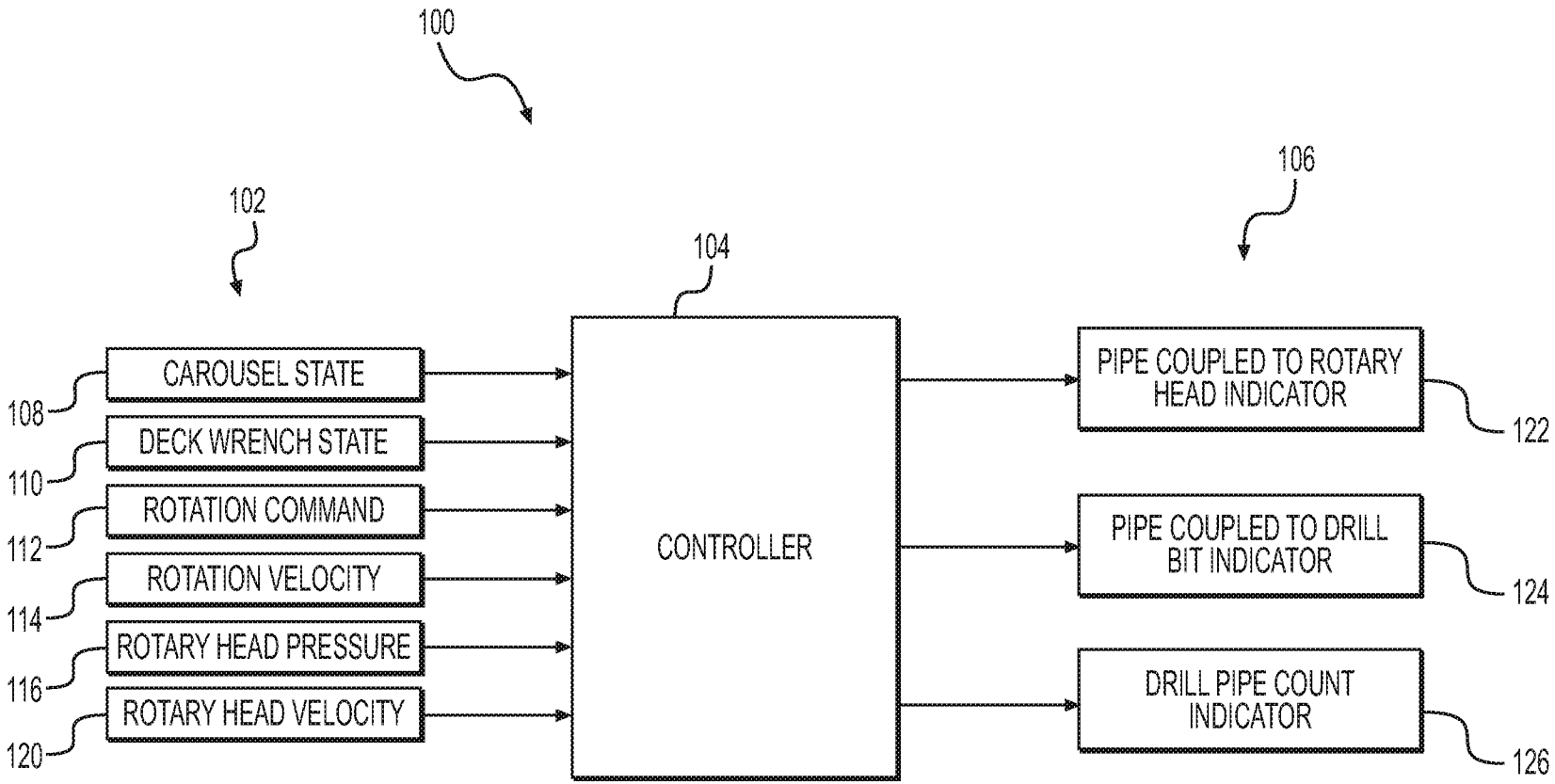
FIG. 3 illustrates a schematic view of the exemplary automatic drill pipe coupling detection control system of the drilling machine of FIG. 1.

FIG. 3 illustrates a schematic view of the automatic drill pipe coupling detection control system 100 of drilling machine 10 for operation and/or control of at least portions of drilling machine 10. Control system 100 may include inputs 102, controller 104, and outputs 106. Inputs 102 may include signals from sensor inputs, for example, carousel state 108, deck wrench state 110, rotation command 112, rotation velocity 114, rotary head pressure 116, and rotary head velocity 120. Outputs 106 may include, for example, pipe coupled to rotary head indicator 122, pipe coupled to drill bit indicator 124, and drill pipe count indicator 126.

Controller 104 may embody a single microprocessor or multiple microprocessors that may include means for detecting and indicating coupling of drill pipes 32 on drill string 30. For example, controller 104 may include a memory (e.g., a non-volatile memory), a secondary storage device, a processor, such as a central processing unit or any other means for accomplishing a task consistent with the present disclosure. The memory or secondary storage device associated with controller 104 may store data and/or software routines that may assist controller 104 in performing its functions. Further, the memory or secondary storage device associated with controller 104 may also store data received from the various inputs 102 associated with drilling machine 10. Numerous commercially available microprocessors can be configured to perform the functions of controller 104. It should be appreciated that controller 104 could readily embody a general machine controller capable of controlling numerous other machine functions. Various other known circuits may be associated with controller 104, including signal-conditioning circuitry, communication circuitry, hydraulic or other actuation circuitry, and other appropriate circuitry.

Carousel state input 108 may include a sensor (e.g., a proximity sensor) that may be configured to detect a position of carousel 36. Carousel state input 108 may communicate a position signal indicative of a position of carousel 36 with respect to the sensor to controller 104. For example, the sensor may be disposed on or near mast frame 24 such that carousel state input 108 may monitor the position of carousel 36 when carousel 36 is pivoted to the add or remove position. Carousel state input 108 may embody a conventional proximity sensor (e.g., an inductive sensor, a capacitive sensor, a photoelectric sensor, etc.) configured to emit an electromagnetic field or a beam of electromagnetic radiation (e.g., infrared) and detect changes in the field or a return signal to determine a position of carousel 36. The signal may be directed to controller 104, which may use the signal to determine a change in the field or signal and use this information to determine a position of carousel 36 when carousel 36 is engaged. Deck wrench state input 110 may include a sensor (e.g., a proximity sensor) that may be configured to detect a position of deck wrench 50. Deck wrench state input 110 may communicate a position signal indicative of a position of deck wrench 50 with respect to the sensor to controller 104. For example, the sensor may be disposed on or near mast frame 24 (e.g., at the bottom deck) such that deck wrench state input 110 may monitor the position of deck wrench 50 when deck wrench 50 is extended to the engaged position. Deck wrench state input 110 may embody a conventional proximity sensor (e.g., an inductive sensor, a capacitive sensor, a photoelectric sensor, etc.) configured to emit an electromagnetic field or a beam of electromagnetic radiation (e.g., infrared) and detect changes in the field or return signal to determine a position of deck wrench 50. The signal may be directed to controller 104, which may use the signal to determine a change in the field or signal and use this information to determine a position of deck wrench 50 when deck wrench 50 is engaged.

Rotation command input 112 may include user input via an input device (not shown), such as a joystick, for controlling rotation direction and velocity of rotary head 26. Rotation command input 112 may communicate a rotation command signal indicative of a command for controlling rotation direction (e.g., clockwise or counterclockwise) and rotation velocity to controller 104. Rotation command input 112 may cause actuation of the valves 44 of hydraulic fluid line of rotary head 26. As such, rotation command input 112 may control rotation direction and rotation velocity of rotary head 26 (and thus the drill string 30). It is understood that rotation command input 112 may also include automatic rotation command from controller 104 (e.g., during an automatic drilling operation) based on signals and/or inputs from various sensors of drilling machine 10.

Rotation velocity input 114 may include a sensor (e.g., a velocity sensor, encoder, or angular position sensor) that may be configured to detect a rotation velocity of the rotary head 26. Rotation velocity input 114 may communicate a rotation velocity signal indicative of a rotation velocity of the rotary head 26 to controller 104. For example, the sensor may be disposed on or near the rotary head 26 and rotation velocity input 114 may monitor the rotation velocity of the rotary head 26. Rotation velocity input 114 may embody a conventional rotational velocity detector having a stationary element rigidly connect to the rotary head 26 that is configured to sense a relative rotational movement of the rotary head (e.g., of a rotational portion of the rotary head 26 that is operatively connected to the rotary head 26, such as a shaft of rotary head 26 or the drill string 30 mounted on the rotary head 26). The stationary element may be a magnetic or optical element mounted to a housing of the rotary head 26 assembly and configured to detect rotation of an indexing element (e.g., a toothed tone wheel, an embedded magnet, a calibration stripe, teeth of a timing gear, etc.) connected to rotate with the shaft of the rotary head 26. A sensor of rotation velocity input 114 may be located adjacent the indexing element and configured to generate a signal each time the indexing element (or a portion thereof) passes near the stationary element. The signal may be directed to controller 104, which may use the signal to determine a number of shaft rotations of the rotary head 26, occurring within fixed time intervals, and use this information to determine the rotation velocity value. Further, two such sensors may be used to determine a rotation direction (e.g., clockwise and/or counterclockwise) of rotary head 26.

Rotary head pressure input 116 may include a sensor (e.g., a pressure sensor) or other mechanism that may be configured to detect a pressure of a fluid supply, such as hydraulic fluid, to the rotary head 26. Rotary head pressure input 116 may communicate a pressure signal indicative of a pressure within a fluid supply line of rotary head 26 to controller 104. As such, the pressure sensor may be disposed within a fluid supply line of rotary head 26. Alternatively, any sensor associated with rotary head pressure input 116 may be disposed in other locations relative to rotary head 26. Rotary head pressure input 116 may also derive rotary head pressure information from other sources, including other sensors.

Rotary head velocity input 120 may include a sensor (e.g., a depth sensor, a velocity sensor, etc.) that may be configured to detect a linear velocity of rotary head 26 as rotary head 26 moves up and down mast frame 24. Rotary head velocity input 120 may communicate a linear velocity signal indicative of a linear velocity of the rotary head 26 to controller 104. For example, the sensor may be disposed on or near the rotary head 26 and rotary head velocity input 120 may monitor the linear velocity of the rotary head 26. Rotary head velocity input 120 may embody a conventional linear velocity detector having a stationary element rigidly connect to mast frame 24 that is configured to sense a relative movement of the rotary head. Alternatively, any sensor associated with rotary head velocity input 120 may be disposed in other locations relative to the rotary head 26 and/or mast frame 24. Further, two such sensors may be used to determine a direction of movement of rotary head 26 (e.g., up and/or down mast frame 24).

For outputs of control system 100, pipe coupled to rotary head indicator 122 may indicate when a drill pipe 32 is coupled to rotary head 26. For example, when a drill pipe 32 is fully coupled to rotary head 26, pipe coupled to rotary head indicator 122 may indicate as such via display 38 (as shown in FIG. 6). Likewise, when a drill pipe 32 is fully decoupled from rotary head 26, pipe coupled to rotary head indicator 122 may indicate as such via display 38. Pipe coupled to drill bit indicator 124 may indicate when a drill pipe 32 is coupled to drill bit 34. For example, when a drill pipe 32 is fully coupled to drill bit 32, pipe coupled to drill bit indicator 124 may indicate as such via display 38 (as shown in FIG. 6). Likewise when a drill pipe 32 is fully decoupled from drill bit 32, pipe coupled to drill bit indicator 124 may indicate as such via display 38. Drill pipe count indicator 126 may indicate the number of drill pipes 32 currently on the drill string 30. For example, when a drill pipe 32 is added to the drill string 30, drill pipe count indicator 126 may increment (e.g., add) one to the count and display the current number of drill pipes 32 on the drill string 30 via display 38 (as shown in FIG. 6). Similarly, when a drill pipe 32 is removed from the drill string 30, drill pipe count indicator 126 may decrement (e.g., subtract) one from the count and display the current number of drill pipes 32 on the drill string 30 via display 38 (as shown in FIG. 6).

INDUSTRIAL APPLICABILITY

The disclosed aspects of automatic drill pipe coupling detection control system 100 of the present disclosure may be used in any drilling machine 10, such as a blasthole drill machine, to detect a coupling of a drill pipe 32 on a drill string 30.

As used herein, the terms automated and automatic are used to describe functions that are done without user intervention. The various functions of FIGS. 4 and 5 are automated or automatic, as detailed below, and thus may all proceed without user intervention.

Figure 4:
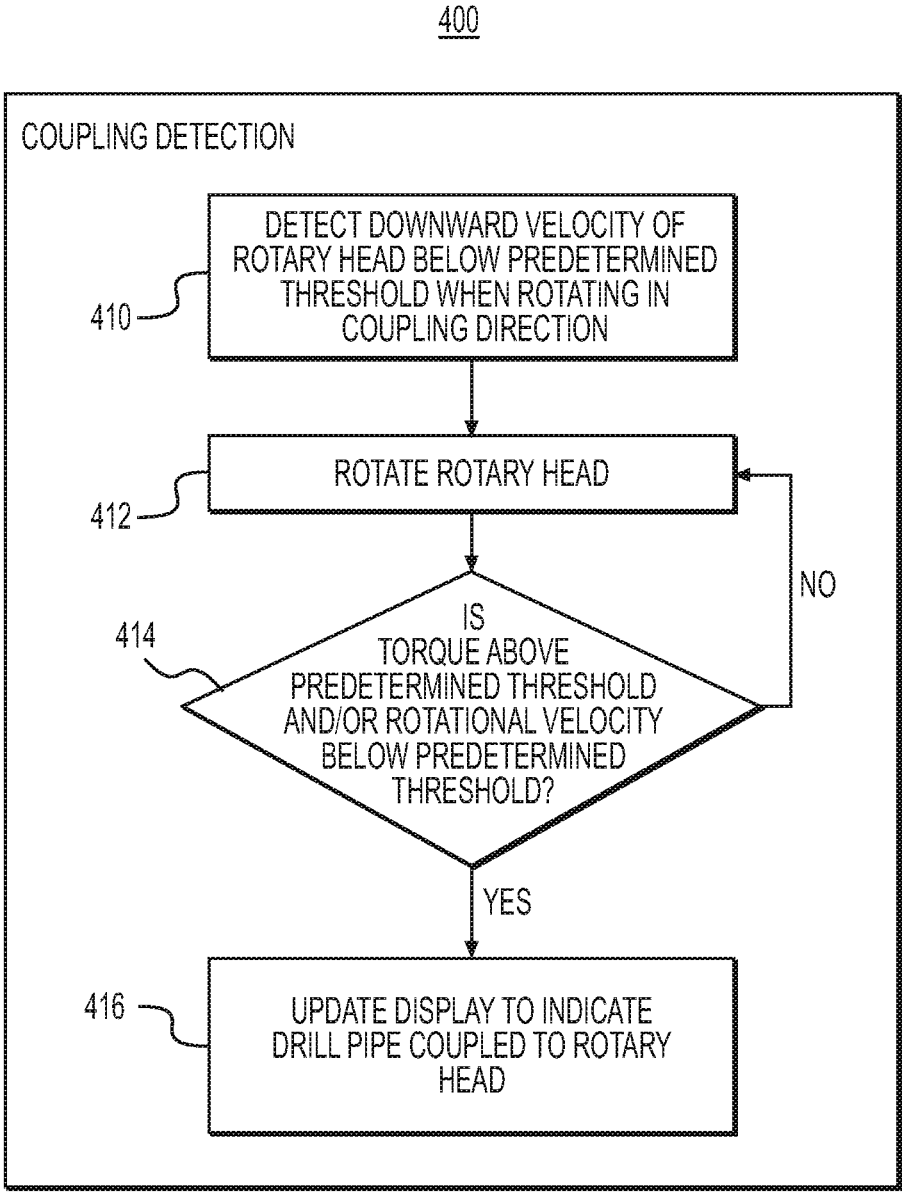
FIG. 4 provides a flowchart depicting an exemplary method for a coupling detection operation of the automatic drill pipe coupling detection control system of FIGS. 1 and 3.
Figure 5:
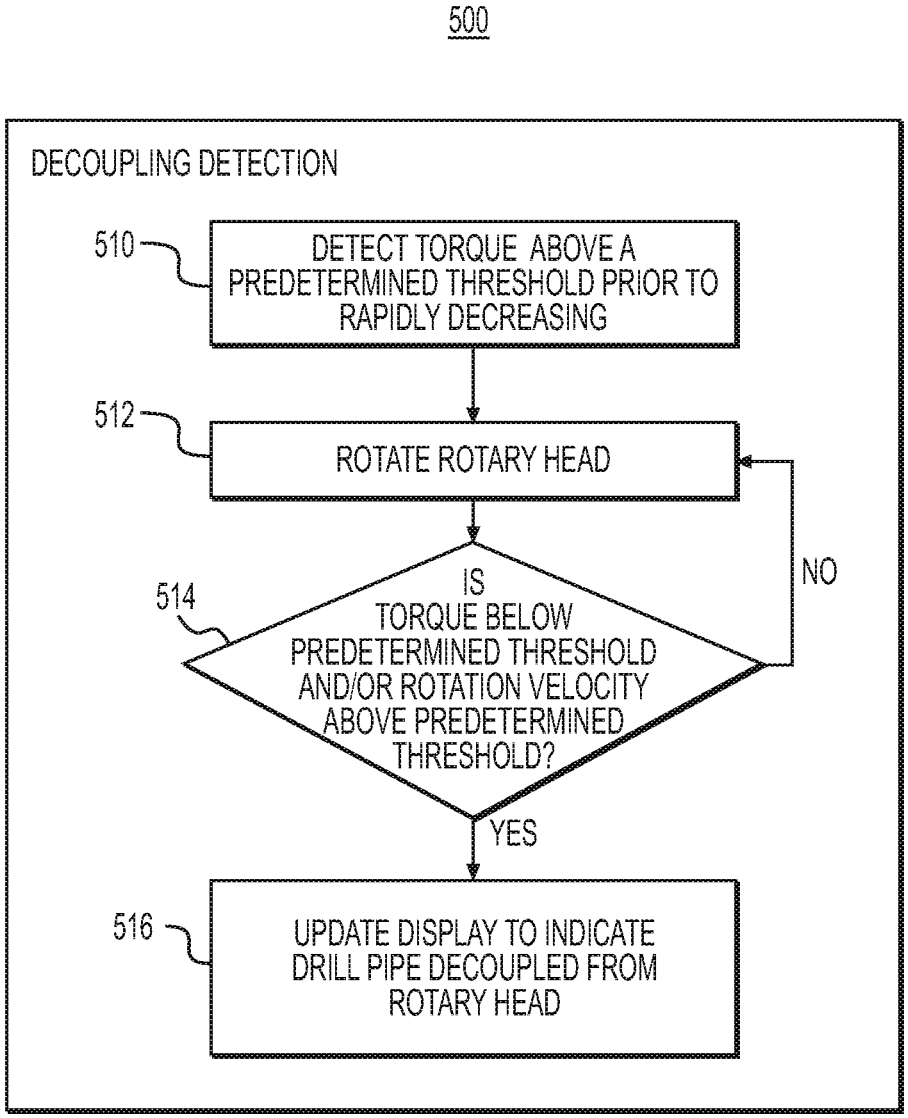
FIG. 5 provides a flowchart depicting an exemplary method for a decoupling detection operation of the automatic drill pipe coupling detection control system of FIGS. 1 and 3.

FIG. 4 provides a flowchart depicting an exemplary method 400 for a coupling detection operation of the automatic drill pipe coupling detection control system 100. While FIG. 4 depicts coupling of a drill pipe 32 to rotary head 26, method 400 may also be used to detect coupling of the drill pipe 32 to drill bit 34, another drill pipe 32, and/or another drill component. Method 400 may be initiated by controller 104 automatically identifying a coupling condition of drill pipe 32. In a preferred embodiment, controller 104 may automatically identify the coupling condition when carousel 36 or deck wrench 50 is engaged and a parameter indicative of a downward velocity (along mast frame 24) of rotary head 26 is below a predetermined threshold when rotary head 26 is rotating in a coupling direction (e.g., clockwise). For example, carousel 36 may be engaged when carousel 36 is pivoted such that drill pipe 32 is aligned with rotary head 26. Deck wrench 50 may be engaged when controlled to extend such that deck wrench 50 prevents drill bit 34 (via adapter 48), or another drill pipe 32 coupled to drill bit 34, from rotating.

Accordingly, an initial step 410 may include controller 104 detecting the parameter indicative of a downward velocity of rotary head 26 is below a predetermined threshold when rotary head 26 is rotating in a coupling direction and when carousel 36 or deck wrench 50 is engaged. In one embodiment, the predetermined threshold may be 100 millimeters per second (mm/s). For example, controller 104 may receive rotation command 112, rotation velocity 114, and rotary head velocity 120 and detect a linear velocity (e.g., downward velocity) of rotary head 26 is below 100 mm/s when the rotary head 26 is rotating in a coupling direction. Detecting the parameter indicative of the downward velocity of rotary head 26 below a predetermined threshold when rotary head 26 is rotating in the coupling direction after carousel 36 or deck wrench 50 has been engaged may indicate that the threads of the rotary head 26 (e.g., of adapter 46) are being mated with the threads of drill pipe 32. Thus, controller 104 may automatically identify the coupling condition of drill pipe 32. Automatically identifying the coupling condition may further include detecting drill string 30 rotating (via rotary head 26) at least one revolution. The detecting of the various conditions may be achieved in any conventional manner, including using appropriate sensors (e.g. position sensors, flow rate sensors, pressure sensors, etc.) associated with components of drilling machine 10.

In step 412, controller 104 may rotate rotary head 26 (e.g., automatically or by operator command) to continue a coupling action of drill pipe 32. For example, controller 104 may rotate rotary head 26 clockwise to couple (e.g., screw) drill pipe 32 to adapter 46 of rotary head 26. It is understood that rotary head 26 may be rotated in any direction (e.g., counterclockwise) to couple drill pipe 32 to adapter 46 of rotary head 26, depending on the configuration of the threaded connection.

In step 414, controller 104 may determine if a parameter indicative of a rotational velocity of rotary head 26 is below a predetermined threshold and a parameter indicative of a torque on rotary head 26 exceeds a predetermined threshold.

For example, the predetermined threshold of the rotational velocity may be approximately zero revolutions per minute (rpm) or equal to zero rpm and the predetermined threshold of the torque may be greater than 300 newton meters (Nm). During the coupling action of drill pipe 32, controller 104 may monitor motion and forces associated with rotary head 26. For example, controller 104 may monitor a parameter indicative of a rotational velocity of rotary head 26, such as rotation velocity input 114. Controller 104 may also monitor a parameter indicative of a torque on the rotary head 26. The torque parameter may be a sensed parameter alone, such as a pressure of rotary head (via input 116), or a calculated parameter based on sensed parameters such as rotation velocity and pressure of rotary head 26. For example, controller 104 may receive rotation velocity input 114 and rotary head pressure input 116 during rotation of rotary head 26 and calculate the torque parameter, as is known in the art. If the parameter indicative of the rotational velocity of rotary head 26 exceeds the predetermined threshold and/or the parameter indicative of the torque of rotary head 26 is below the predetermined threshold (step 414: NO), method 400 may continue from step 412 such that controller 104 may continuously rotate rotary head 26 during the coupling action. In one embodiment, a single parameter indicator may be used, such that controller 104 may determine if either the parameter indicative of the rotational velocity is below the predetermined threshold or the parameter indicative of the torque on the rotary head 26 exceeds the predetermined threshold.

If the parameter indicative of the rotational velocity of rotary head 26 is below the predetermined threshold and/or the parameter indicative of the torque on rotary head 26 exceeds the predetermined threshold (step 414: YES), controller 104 may update display 38 to indicate the drill pipe 32 is fully coupled to rotary head 26 (step 416). For example, when the parameter indicative of the rotation velocity of rotary head 26 is below the predetermined threshold (e.g., about zero rpm) and/or the parameter indicative of the torque on rotary head 26 exceeds the predetermined threshold (e.g., above 300 Nm), controller 104 may determine a fully coupled condition of drill pipe 32. As used herein, a fully coupled condition indicates when a drill pipe 32 is completely fastened to rotary head 26, drill bit 34, or another drill pipe 32 such that drill pipe 32 is sufficiently coupled so as to avoid failure during operation, but not overly torqued. As such, controller 104 may automatically identify the fully coupled condition of the coupling action based on the monitored motion and forces of rotary head 26. In one embodiment, controller 104 may control drill pipe coupled to rotary head indicator 122 to update display 38 to indicate the fully coupled condition of drill pipe 32 to rotary head 26 (as shown in FIG. 6). For example, drill pipe coupled to rotary head indicator 122 may be displayed as green (or any other color or indicator) on display 38 to indicate that a drill pipe 32 is coupled to rotary head 26. Likewise, controller 104 may control drill pipe coupled to drill bit indicator 124 to update display 38 to indicate the fully coupled condition of drill pipe 32 to drill bit 34 (as shown in FIG. 6). For example, drill pipe coupled to drill bit indicator 124 may be displayed as green (or any other color or indicator) on display 38 to indicate that a drill pipe 32 is coupled to drill bit 34.

When controller 104 identifies the fully coupled condition of the coupling action, controller 104 may terminate the coupling action based on the identification of the fully coupled condition. When the fully coupled condition is completed at rotary head 26, operation may proceed to couple drill pipe 32 to drill bit 34 or to another drill pipe 32 already coupled to drill bit 34. As such, method 400 may repeat during the coupling action of drill pipe 32 to drill bit 34 accordingly. Controller 104 may store the fully coupled condition in the memory (e.g., the non-volatile memory) even if drilling machine 10 has been shut down such that the stored fully coupled conditions may be used when drilling machine 10 has been re-started for additional operation. After drill pipe 32 is fully coupled to both rotary head 26 and drill bit 34 (or to drill bit 34 via another drill pipe 32), controller 104 may proceed with a drilling operation of drilling machine 10.

Additionally, controller 104 may display a count of drill pipes 32 on drill string 30 connected to rotary head 26 via drill pipe count indicator 126 (as shown in FIG. 6). Controller 104 may update the count of drill pipes 32 on display 38 based on the identification of the fully coupled condition of the drill pipe 32 to the rotary head 26. For example, when drill pipe 32 is fully coupled to rotary head 26, controller 104 may control drill pipe count indicator 126 to increment (e.g., add) one to the count of drill pipes 32 on drill string 30 connected to rotary head 26. Alternatively, controller 104 may update the count of drill pipes 32 on display 38 based on other conditions. For example, controller 104 may update the count of drill pipes 32 based on identification of the fully coupled condition of the drill pipe 32 to the drill bit 34, other drill pipes 32, or to both the rotary head 26 and the drill bit 34 (or other drill pipes 32).

FIG. 5 provides a flowchart depicting an exemplary method 500 for a decoupling detection operation of the automatic drill pipe coupling detection control system 100. While FIG. 5 depicts decoupling of a drill pipe 32 from rotary head 26, method 500 may also be used to detect decoupling of the drill pipe 32 from drill bit 34 or from another drill pipe 32. Method 500 may be initiated by controller 104 automatically identifying a decoupling condition of drill pipe 32. In a preferred embodiment, controller 104 may automatically identify the decoupling condition when carousel 36 or deck wrench 50 is engaged (as detailed above) and a decoupling rotation command is received, but no rotation is detected. As such, a parameter indicative of torque on the rotary head 26 may increase prior to rapidly decreasing and rotary head 26 may then rotate in the decoupling direction. Accordingly, an initial step 510 may include controller 104 detecting a parameter indicative of a torque on the rotary head 26 exceeding a predetermined threshold prior to rapidly decreasing and rotary head 26 rotating in the decoupling direction. The predetermined threshold may correspond to an initial loosening of the coupling in order to overcome a force of the coupling. For example, the predetermined threshold of the torque may be 1,000 Nm to initially loosen the coupling of the drill pipe 32 with the rotary head 26 or drill bit 34 (or another drill pipe 32). Automatically identifying the decoupling condition may further include detecting an upward velocity of rotary head 26 being less than a predetermined threshold (e.g., 100 mm/s), a rotation direction of rotary head 26 in a decoupling direction (e.g., counterclockwise), and/or drill string 30 rotates (via rotary head 26) at least one revolution. The detecting of the various conditions may be achieved in any conventional manner, including using appropriate sensors (e.g. position sensors, flow rate sensors, pressure sensors, etc.) associated with components of drilling machine 10.

In step 512, controller 104 may rotate rotary head 26 (e.g., automatically or by operator command) to continue the decoupling action of drill pipe 32 after controller 104 detects the parameter indicative of torque of rotary head 26 has rapidly decreased and rotary head 26 rotates in the decoupling direction. For example, controller 104 may rotate rotary head 26 counterclockwise to decouple (e.g., unscrew) drill pipe 32 from adapter 46 of rotary head 26. It is understood that rotary head 26 may be rotated in any direction (e.g., clockwise) to decouple drill pipe 32 to adapter 46 of rotary head 26, depending on the configuration of the threaded connection.

In step 514, controller 104 may determine if a parameter indicative of the rotational velocity of rotary head 26 exceeds a predetermined threshold and/or a parameter indicative of the torque on rotary head 26 decreases below a predetermined threshold. During the decoupling action of drill pipe 32, controller 104 may monitor motion and forces associated with rotary head 26. For example, controller 104 may monitor a parameter indicative of a rotational velocity of rotary head 26 and/or a parameter indicative of a torque on the rotary head 26, as detailed above. If the parameter indicative of the rotational velocity of rotary head 26 is below the predetermined threshold and/or the parameter indicative of the torque of rotary head 26 is greater than the predetermined threshold (step 514: NO), method 500 may continue from step 512 such that controller 104 may continuously rotate rotary head 26 during the decoupling action. In one embodiment, a single parameter indicator may be used, such that controller 104 may determine if either the parameter indicative of the rotational velocity of rotary head 26 is below the predetermined threshold or the parameter indicative of the torque on rotary head 26 exceeds the predetermined threshold.

If the parameter indicative of the rotational velocity of rotary head 26 exceeds the predetermined threshold and/or the parameter indicative of the torque on rotary head 26 decreases below the predetermined threshold (step 414: YES), controller 104 may update display 38 to indicate the drill pipe 32 is decoupled from rotary head 26 (step 516). For example, when the parameter indicative of the rotation velocity of rotary head 26 exceeds the predetermined threshold and/or the parameter indicative of the torque on rotary head 26 decreases below the predetermined threshold, controller 104 may determine a fully decoupled condition of drill pipe 32. As used herein, a fully decoupled condition indicates when a drill pipe 32 is completely unfastened from rotary head 26, drill bit 34, or another drill pipe 32 such that rotary head 26 is able to freely rotate and be removed from drill pipe 32, drill bit 34, or another drill pipe 32. As such, controller 104 may automatically identify the fully decoupled condition of the decoupling action based on the monitored motion and forces of rotary head 26. In one embodiment, controller 104 may control drill pipe coupled to rotary head indicator 122 to update display 38 to indicate the fully decoupled condition of drill pipe 32 from rotary head 26. For example, drill pipe coupled to rotary head indicator 122 may be displayed as red (or any other color or indicator) on display 38 to indicate that a drill pipe 32 is decoupled from (e.g., not coupled to) rotary head 26. Likewise, controller 104 may control drill pipe coupled to drill bit indicator 124 to update display 38 to indicate the fully decoupled condition of drill pipe 32 from drill bit 34. For example, drill pipe coupled to drill bit indicator 124 may be displayed as red (or any other color or indicator) on display 38 to indicate that a drill pipe 32 is decoupled from (e.g., not coupled to) drill bit 34.

When controller 104 identifies the fully decoupled condition of the decoupling action, controller 104 may terminate the decoupling action based on the identification of the fully decoupled condition. If drill pipe 32 is fully decoupled from the drill bit 34 or another drill pipe 32 at the deck wrench 50, operation may proceed with decoupling the drill pipe 32 from rotary head 26. Further, if drill pipe 32 is decoupled from rotary head 26 at the deck wrench 50, operation may proceed to couple a different drill pipe 32 to rotary head 26 to add the different drill pipe 32 to the drill string 34. As such, method 500 may repeat during the decoupling action of drill pipe 32 from drill bit 34, rotary head 26, or another drill pipe 32 accordingly. Controller 104 may store the fully decoupled condition in the memory (e.g., the non-volatile memory) even if drilling machine 10 has been shut down such that the stored fully decoupled conditions may be used when drilling machine 10 has been re-started for additional operation.

Additionally, as noted above controller 104 may display a count of drill pipes 32 on drill string 30 connected to rotary head 26 via drill pipe count indicator 126 (as shown in FIG. 6). Controller 104 may update the count of drill pipes 32 on display 38 based on the identification of the fully decoupled condition of the drill pipe 32 from the rotary head 26. For example, when drill pipe 32 is fully decoupled from rotary head 26 (e.g., at carousel 36), controller 104 may control drill pipe count indicator 126 to decrement (e.g., subtract) one from the count of drill pipes 32 on drill string 30 connected to rotary head 26. Alternatively, controller 104 may update the count of drill pipes 32 on display 38 based on other conditions. For example, controller 104 may update the count of drill pipes 32 based on identification of the fully decoupled condition of the drill pipe 32 from the drill bit 34, other drill pipes 32, or from both the drill bit 34 (or other drill pipes 32) and the rotary head 26. Further, controller 104 may store the drill pipe count in the memory (e.g., the non-volatile memory) even if drilling machine 10 has been shut down such that the stored drill pipe count may be used when drilling machine 10 has been re-started for additional operation.

Such an automatic drill pipe coupling detection control system 100 of the present disclosure may automatically and accurately detect when a drill pipe 32 is fully coupled or decoupled from rotary head 26 and/or drill bit 34. As such, control system 100 may provide for increased efficiency and robustness in adding or removing drill pipes 32 from drill string 30 while helping to ensure that the drill pipe 32 is fully coupled or decoupled. Thus, drilling time may be reduced and reliability of the drill string 30 coupling may be increased. Further, such a reliability of the drill string 30 coupling due to the control system 100 may help facilitate a fully automated and/or autonomous drilling operation.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for automatic detection of drill pipe coupling on a drilling machine, comprising:

a rotary head;

a drill pipe;

a display; and a controller configured to:

automatically identify a coupling or decoupling condition of the drill pipe, wherein the automatically identifying of the coupling condition of the drill pipe includes detecting a parameter indicative of a downward velocity of the rotary head is below a predetermined threshold when the rotary head rotates in a coupling direction after a carousel or deck wrench of the drilling machine is engaged;

monitor motion and forces associated with the rotary head during a coupling or decoupling action of the drill pipe;

automatically identify a fully coupled or fully decoupled condition of the coupling or decoupling action based on the monitored motion and forces of the rotary head;

terminate the coupling action based on the identification of the fully coupled or fully decoupled condition; and update the display to indicate the fully coupled or fully decoupled condition of the drill pipe.

2. The system of claim 1, wherein the automatically identifying of the decoupling condition of the drill pipe includes detecting a parameter indicative of a torque on the rotary head exceeding a predetermined threshold prior to rapidly decreasing when the carousel or deck wrench is engaged.

3. The system of claim 1, wherein the coupling or decoupling condition of the drill pipe includes coupling or decoupling the drill pipe to one of the rotary head, a drill bit, or another drill pipe.

4. The system of claim 1, wherein the monitoring of the motion of the rotary head includes monitoring a parameter indicative of a rotational velocity of the rotary head.

5. The system of claim 4, wherein the monitoring of the force of the rotary head includes monitoring a parameter indicative of a torque on the rotary head.

6. The system of claim 5, wherein a fully coupled condition corresponds to at least one of the parameter indicative of the rotational velocity of the rotary head decreasing below a predetermined threshold or the parameter indicative of the torque on the rotary head exceeding a predetermined threshold.

7. The system of claim 5, wherein a fully decoupled condition corresponds to at least one of the parameter indicative of the rotational velocity of the rotary head exceeding a predetermined threshold or the parameter indicative of the torque on the rotary head decreasing below a predetermined threshold.

8. A system for automatic detection of drill pipe count on a drilling machine, comprising:

a rotary head;

a drill pipe;

a display; and a controller configured to:

automatically identify a coupling or decoupling condition of the drill pipe, wherein the automatically identifying of the coupling condition of the drill pipe includes detecting a parameter indicative of a downward velocity of the rotary head is below a predetermined threshold when the rotary head rotates in a coupling direction after a carousel or deck wrench of the drilling machine is engaged;

monitor motion and forces associated with the rotary head during a coupling or decoupling action of the drill pipe;

automatically identify a fully coupled or fully decoupled condition of the coupling or decoupling action based on the monitored motion and forces of the rotary head;

terminate the coupling action based on the identification of the fully coupled or fully decoupled condition;

display a count of drill pipes of a drill string connected to the rotary head; and update the count of drill pipes displayed based on the identification of the fully coupled or decoupled condition of the drill pipe to the rotary head.

9. The system of claim 8, wherein the monitoring of the motion of the rotary head includes monitoring a parameter indicative of a rotational velocity of the rotary head when a carousel or deck wrench of the drilling machine is engaged.

10. The system of claim 9, wherein the monitoring of the force of the rotary head includes monitoring a parameter indicative of a torque on the rotary head when the carousel or deck wrench is engaged.

11. The system of claim 10, wherein a fully coupled condition corresponds to at least one of the parameter indicative of the rotational velocity of the rotary head decreasing below a predetermined threshold or the parameter indicative of the torque on the rotary head exceeding a predetermined threshold.

12. The system of claim 11, wherein the updating of the count of drill pipes displayed includes incrementing the count of drill pipes when the fully coupled condition is identified at at least one of the rotary head, a drill bit, or another drill pipe.

13. The system of claim 10, wherein a fully decoupled condition corresponds to at least one of the parameter indicative of the rotational velocity of the rotary head exceeding a predetermined threshold or the parameter indicative of the torque on the rotary head decreasing below a predetermined threshold.

14. The system of claim 13, wherein the updating of the count of drill pipes displayed includes decrementing the count of drill pipes when the fully decoupled condition is identified at at least one of the rotary head, a drill bit, or another drill pipe.

15. A method for automatic detection of drill pipe coupling on a drilling machine, comprising:

automatically identifying a coupling or decoupling condition of a drill pipe, wherein the automatically identifying of the coupling condition of the drill pipe includes detecting a parameter indicative of a downward velocity of a rotary head is below a predetermined threshold when the rotary head rotates in a coupling direction after a carousel or deck wrench of the drilling machine is engaged;

monitoring motion and forces associated with rotary head of the drilling machine during a coupling or decoupling action of the drill pipe;

automatically identifying a fully coupled or fully decoupled condition of the coupling or decoupling action based on the monitored motion and forces of the rotary head;

terminating the coupling action based on the identification of the fully coupled or fully decoupled condition; and updating a display of the drilling machine to indicate the fully coupled or fully decoupled condition of the drill pipe.

16. The method of claim 15, wherein the monitoring of the motion of the rotary head includes monitoring a parameter indicative of a rotational velocity of the rotary head.

17. The method of claim 16, wherein the monitoring of the force of the rotary head includes monitoring a parameter indicative of a torque on the rotary head.

18. The method of claim 17, wherein a fully coupled condition corresponds to at least one of the parameter indicative of the rotational velocity of the rotary head decreasing below a predetermined threshold or the parameter indicative of the torque on the rotary head exceeding a predetermined threshold.

19. The method of claim 17, wherein a fully decoupled condition corresponds to at least one of the parameter indicative of the rotational velocity of the rotary head exceeding a predetermined threshold or the parameter indicative of the torque on the rotary head decreasing below a predetermined threshold.

* * * * *